US007052748B2

(12) United States Patent
Kapusniak et al.

(10) Patent No.: US 7,052,748 B2
(45) **Date of Patent: *May 30, 2006**

(54) MORDANTED INKJET RECORDING ELEMENT AND PRINTING METHOD

(75) Inventors: Richard J. Kapusniak, Webster, NY (US); Charles E. Romano, Jr., Rochester, NY (US); Lori J. Shaw-Klein, Rochester, NY (US); Terry C. Schultz, Hilton, NY (US); Peter J. Ghyzel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 24 days.

This patent is subject to a terminal disclaimer.

(21) Appl. No.: 10/758,720

(22) Filed: Jan. 16, 2004

(65) Prior Publication Data

US 2005/0157147 A1 Jul. 21, 2005

(51) Int. Cl.
*B41M 5/00* (2006.01)

(52) U.S. Cl. ..... 428/32.15; 347/105; 347/106; 428/32.34; 428/32.37; 428/32.29; 428/32.36

(58) Field of Classification Search ..... 428/32.25, 428/32.36, 32.37
See application file for complete search history.

(56) References Cited

U.S. PATENT DOCUMENTS

| | | | | |
|---|---|---|---|---|
| 6,254,845 | B1 | 7/2001 | Ohashi et al. | |
| 6,341,560 | B1 | 1/2002 | Shah et al. | |
| 6,447,114 | B1 | 9/2002 | Sunderrajan et al. | |
| 6,548,149 | B1 * | 4/2003 | Liu et al. | 156/235 |
| 6,596,250 | B1 * | 7/2003 | Greenwood et al. | 423/335 |
| 6,632,489 | B1 * | 10/2003 | Watanabe et al. | 428/32.34 |
| 2003/0112311 | A1 | 6/2003 | Naik et al. | |

FOREIGN PATENT DOCUMENTS

| | | |
|---|---|---|
| EP | 0 903 246 A2 | 3/1999 |
| EP | 0 968 836 A2 | 1/2000 |
| JP | 09234948 | 9/1997 |
| WO | 2004/009367 | 1/2004 |
| WO | 2004/009368 | 1/2004 |

* cited by examiner

*Primary Examiner*—Pamela R. Schwartz
(74) *Attorney, Agent, or Firm*—Chris P. Konkol

(57) ABSTRACT

An inkjet recording element comprising a support having thereon, in order, a support having thereon an ink-receiving layer comprising a hydrophilic polymer, a polymeric mordant, and particles of an aluminosilicate. Such recording elements exhibit improved humidity keeping.

19 Claims, No Drawings

MORDANTED INKJET RECORDING ELEMENT AND PRINTING METHOD

CROSS REFERENCE TO RELATED APPLICATIONS

Reference is made to commonly assigned, co-pending U.S. patent application Ser. No. 10/759,876 by Richard J. Kapusniak et al. filed of even date herewith, titled "Non-Porous InkJet Recording Element and Printing Method" and U.S. patent application Ser. No. 10/759,896 by Richard J. Kapusniak et al. filed of even date herewith, titled "InkJet Recording Element Comprising Subbing Layer and Printing Method."

FIELD OF THE INVENTION

The present invention relates to an inkjet recording element and a printing method using the element.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink-recording element typically comprises a support having on at least one surface thereof an ink-receiving or image-forming layer, and includes those intended for reflection viewing, which have an opaque support, and those intended for viewing by transmitted light, which have a transparent support.

In order to achieve and maintain high quality images on such an image-recording element, the recording element must exhibit no banding, bleed, coalescence, or cracking in inked areas; exhibit the ability to absorb large amounts of ink and dry quickly to avoid blocking; exhibit high optical densities in the printed areas; exhibit freedom from differential gloss; exhibit high levels of image fastness to avoid fade from contact with water or radiation by daylight, tungsten light, or fluorescent light or exposure to gaseous pollutants; and exhibit excellent adhesive strength so that delamination does not occur.

Titanium dioxide, zinc oxide, silica, and polymeric beads such as cross-linked poly(methyl methacrylate) or polystyrene beads have been used in the receiving layer or layers used in ink recording elements for the purposes of contributing to the non-blocking characteristics of the recording elements or to control the smudge resistance thereof.

U.S. Pat. No. 6,447,114 issued Sep. 10, 2002 to Sunderrajan et al., titled "Inkjet Printing Method," uses inorganic pigments in a porous overcoat. The amount of inorganic pigment used may range from about 50 to about 95% of the image-receiving layer. Such particles include silica, alumina, calcium carbonate, modified kaolin clay, montmorillinite clay, hydrotactite clay, and laponite clay.

U.S. Patent Publication No. 2003/0112311 A1 published Jun. 19, 2003 by Naik et al., titled "Topcoat Compositions, Substrates Containing A Topcoat Derived Therefrom, and Methods of Preparing the Same" discloses an ink-receptive composition comprising a filler, binder such as polyvinyl alcohol, cationic polymer.

U.S. Pat. No 6,341,560 issued Jan. 29, 2002 to Shah et al., titled "Imaging And Printing Methods Using Clay-containing Fluid Receiving Element," discloses a lithographic imaging member that is prepared by applying an ink-jetable fluid to a fluid-receiving element that includes a clay-containing fluid-receiving surface layer. Useful clays that are used are either synthetic or naturally occurring materials, including but not limited to kaolin (aluminum silicate hydroxide) and many other clays such as serpentine, montmorillonites, illites, glauconite, chlorite, vermiculites, bauxites, attapulgites, sepiolites, palygorskites, corrensites, allophanes, imoglites, and others.

Aluminosilicates are known in various forms. For example aluminosilicate polymers are known in fiber form, such as imogolite. Imogolite is a filamentary, tubular and crystallized aluminosilicate, present in the impure natural state in volcanic ashes and certain soils; it was described for the first time by Wada in Journal of Soil Sci. 1979, 30(2), 347–355. In comparison, allophanes are in the form of substantially amorphous particles.

Naturally occurring allophane is a series name used to describe clay-sized, short-range ordered aluminosilicates associated with the weathering of volcanic ashes and glasses. Such natural allophane commonly occurs as very small rings or spheres having diameters of approximately 35–50 Å (3.5 to 5.0 nm). This morphology is characteristic of allophane, and can be used in its identification. Naturally occurring allophanes have a composition of approximately $Al_2Si_2O_5.nH_2O$. Some degree of variability in the Si:Al ratios is present. Wada reports Si:Al ratios varying from about 1:1 to 2:1. Because of the exceedingly small particle size of allophane and the intimate contact between allophane and other clays (such as smectites, imogolite, or non-crystalline Fe and Al oxides and hydroxides and silica) in the soil, it has proven very difficult to accurately determine the composition of naturally occurring allophane. Allophane usually gives weak XRD peaks at 2.25 and 3.3 Å. Identification is commonly made by infrared analyses or based on transmission electron morphology.

A limited amount of isomorphous substitution occurs in natural allophane. The most common type is the substitution of Fe for Al. In some cases, the color of this natural allophane is dark yellow due to the presence of Fe3+, the presence of which can interfere with making Raman spectrum of the natural allophane due to the presence of this Fe3+ traces (fluoresence under the laser excitation).

Little permanent charge is typically present in natural allophane. The majority of the charge is variable charge, and both cation and anion exchange capacities exist, with the relative amounts depending on the pH and ionic strength of the soil chemical environment.

Synthetic allophane, like natural allophane, is also a substantially amorphous material having weak XRD signals. The particle size (average diameter) typically is in the range of about 4 to 5.5 nm. Due to their small size, it is difficult to obtain a photo of a single unit of synthetic allophane, but they commonly appear substantially spherical, which spheres are usually hollow. The zeta potential of synthetic allophane is positive, which is in the range of other pure alumina materials. There is data supporting the chemical anisotropy of synthetic allophane, with aluminols at the outer surface, silanols wrapping the inner surface. Aluminosilicate polymers, in spherical particle form, that can be described as synthetic allophanes are disclosed in U.S. Pat. No. 6,254,845 issued Jul. 3, 2001 to Ohashi et al., titled "Synthesis Method Of Spherical Hollow Aluminosilicate Cluster," which patent describes an improved method for preparing hollow spheres of amorphous aluminosilicate polymer similar to natural allophane. This patent also refers to Wada, S., Nendo Kagaku (Journal of the Clay Science Soc. of Japan), Vol. 25, No. 2, pp. 53–60, 1985) for another synthesis of amorphous aluminosilicate superfine particles. The aluminosilicate polymers in U.S. Pat. No. 6,254,845 to Ohashi et al. are within a range of 1–10 nm, shaped as hollow spheres, and are observed to form hollow spherical silicate "clusters" or aggregates in which pores are formed. The patent to Ohashi et al. states that powder X-ray diffraction reveals two broad peaks close to 27° and 40° at 2θ on the Cu—$K_\alpha$ line, which correspond to a non-crystalline (substantially amorphous) structure and which is characteristic of spherical particles referred to as allophane. In addition, observations under a transmission microscope reveal a state in which hollow spherical particles with diameters of 3–5 nm are evenly distributed.

Regarding the Al/Si ratio, it is believed that sufficient silanol group is needed to form an homogeneous layer of silicate on the face of the proto gibbsite sheet, sufficient to curl this protogibbsite sheet and finally allowing a closo structure to be obtained. The Al/Si ratio, therefore, has to be in the range 1 to 4.

Two types of synthetic allophane, referred to as hybrid and classical, are disclosed in French Applications FR 0209086 and FR 0209085 filed on Jul. 18, 2002. Hybrid Synthetic allophanes show the same fingerprints as classical allophane with some additional bands due to the presence of organic groups.

As indicated above, synthetic and natural allophane are generally non-crystalline materials, which include both amorphous and short-range ordered materials such as microcrystalline materials. Amorphous materials are at the opposite extreme from crystalline materials—they do not have a regularly repeating structure, even on a molecular scale. Their compositions may be regular or, as is more commonly the case, they may have a large degree of variability. They do not produce XRD peaks. Since the term amorphous is sometime applied to materials that are truly amorphous, like volcanic glass, the term x-ray amorphous or simply non-crystalline can be used to describe allophanes and other short-range ordered materials that may show weak XRD peaks and hence not completely amorphous. Such aluminosilicate materials will be referred to herein as substantially amorphous. Short-range ordered materials can sometimes be identified by XRD or selective dissolution in conjunction with differential XRD.

While a wide variety of different types of image recording elements for use with ink printing are known, there are many unsolved problems in the art and many deficiencies in the known products, which have severely limited their commercial usefulness. A major challenge in the design of an image-recording element is to provide heat and humidity keeping, especially for swellable, non-porous recording elements.

It is an object of this invention to provide a multilayer ink recording element that has excellent image quality and improved humidity keeping.

Still another object of the invention is to provide a printing method using the above-described element.

SUMMARY OF THE INVENTION

These and other objects are achieved by the present invention which comprises an inkjet recording element comprising a support having thereon a ink-receiving layer comprising a hydrophilic polymer, a polymeric mordant, and particles of an aluminosilicate as described below.

Such recording elements, which comprise one or more non-porous (swellable) hydrophilic absorbing layers, exhibit improved humidity keeping and excellent image quality.

In a preferred embodiment of the invention, the ratio of hydrophilic polymer to the aluminosilicate particles is about from about 95:5 to about 75:25. The hydrophilic polymer is preferably poly(vinyl alcohol).

Another embodiment of the invention relates to an inkjet printing method comprising the steps of: A) providing an inkjet printer that is responsive to digital data signals; B) loading the inkjet printer with the inkjet recording element described above; C) loading the inkjet printer with an inkjet ink; and D) printing on the inkjet recording element using the inkjet ink in response to the digital data signals.

As used herein, the terms "over," "above," and "under" and the like, with respect to layers in the inkjet media, refer to the order of the layers over the support, but do not necessarily indicate that the layers are immediately adjacent or that there are no intermediate layers.

DETAILED DESCRIPTION OF THE INVENTION

As noted above, at least one hydrophilic absorbing layer (or ink-receiving layer) comprises a natural or synthetic polymer. Preferred is a hydrophilic absorbing layer comprising gelatin or poly (vinyl alcohol) (PVA). This layer may also contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly (ethylene imine), poly(acrylic acid), poly(methacrylic acid), n-vinyl amides including polyacrylamide and polyvinyl pyrrolidinone (PVP), and poly(vinyl alcohol) derivatives and copolymers, such as copolymers of poly(ethylene oxide) and poly(vinyl alcohol) (PEO-PVA).

The gelatin used in the present invention may be made from animal collagen, but gelatin made from pig skin, cow skin, or cow bone collagen is preferable due to ready availability. The kind of gelatin is not specifically limited, but lime-processed gelatin, acid processed gelatin, amino group inactivated gelatin (such as acetylated gelatin, phthaloylated gelatin, malenoylated gelatin, benzoylated gelatin, succinylated gelatin, methyl urea gelatin, phenylcarbamoylated gelatin, and carboxy modified gelatin), or gelatin derivatives (for example, gelatin derivatives disclosed in JP Patent publications 38-4854/1962, 39-5514.1964, 40-12237/1965, 42-26345/1967, and 2-13595/1990; U.S. Pat. Nos. 2,525,753, 2,594,293, 2,614,928, 2,763,639, 3,118,766, 3,132,945, 3,186,846, 3,312,553; and GB Patents 861,414 and 103, 189) can be used singly or in combination. Most preferred are pigskin or modified pigskin gelatins and acid processed osseine gelatins due to their effectiveness for use in the present invention.

The hydrophilic absorbing layer or layers must effectively absorb both the water and humectants commonly found in printing inks as well as the recording agent. In one embodiment of the invention, two or more hydrophilic absorbing layers may be present, including the ink-receiving layer, an optional base layer between the support and the ink-receiving layer and an optional overcoat or topcoat layer, over the ink-receiving layer. The ink-receiving layer, the base layer, the overcoat layer, and any other hydrophilic ink-absorbing layers will collectively be referred to as the hydrophilic absorbing layers. In one embodiment of the present invention, the base layer comprises gelatin, and the other comprises one or more hydrophilic material selected from naturally-occurring hydrophilic colloids and gums such as albumin, guar, xantham, acacia, chitosan, starches and their derivatives, functionalized proteins, functionalized gums and starches, cellulose ethers and their derivatives, polyvinyloxazoline, such as poly(2-ethyl-2-oxazoline) (PEOX), non-modified gelatins, polyvinylmethyloxazoline, polyoxides, polyethers, poly(ethylene imine), n-vinyl amides including polyacrylamide and polyvinyl pyrrolidinone (PVP), poly(vinyl alcohol) and poly(vinyl alcohol) derivatives and copolymers, such as copolymers of poly(ethylene oxide) and poly(vinyl alcohol) (PEO-PVA), polyurethanes, and polymer latices such as polyesters and acrylates. Derivitized poly(vinyl alcohol) includes, but is not limited to, polymers having at least one hydroxyl group replaced by ether or ester groups which may be used in the invention may comprise an acetoacetylated poly(vinyl alcohol) in which the hydroxyl groups are esterified with acetoacetic acid.

In one embodiment of the invention, the hydrophilic absorbing layers comprise a first hydrophilic absorbing layer, a base layer comprising gelatin, and at least one upper layer or second hydrophilic absorbing layer (also referred to as the "ink-receiving layer"), located between the base layer and an optional overcoat layer, comprising poly(vinyl alcohol). These embodiments provide enhanced image quality.

As noted above, the poly(vinyl alcohol) employed in the invention has a degree of hydrolysis of at least about 50% and has a number average molecular weight of at least about 45,000. In a preferred embodiment of the invention, the poly(vinyl alcohol) has a degree of hydrolysis of about 70 to 99%, more preferably about 75 to 90%. Commercial embodiments of such a poly(vinyl alcohol) include Gohsenol® AH-22, Gohsenol® AH-26, Gohsenol® KH-20, and Gohsenol® GH-17 from Nippon Gohsei and Elvanol®52-22 from DuPont (Wilmington, Del.).

The dry layer thickness of the ink-receiving layer is preferably from 0.5 to 15 μm (more preferably 1 to 10 microns). The preferred dry coverage of an optional overcoat layer is from 0.5 to 5 μm (more preferably 0.5 to 1.5 microns) as is common in practice. The dry layer thickness of an optional base layer is preferably from 5 to 60 microns (more preferably 6 to 15 microns), below which the layer is too thin to be effective and above which no additional gain in performance is noted with increased thickness.

The binder for the optional overcoat can be any of the polymers mentioned above for the hydrophilic absorbing layers. In a preferred embodiment of the invention, the overcoat comprises poly(vinyl alcohol), hydroxypropyl cellulose, hydroxypropyl methyl cellulose, gelatin, and/or a poly(alkylene oxide). In a still more preferred embodiment, the hydrophilic binder in the overcoat is poly(vinyl alcohol). This layer may also contain other hydrophilic materials such as cellulose derivatives, e.g., cellulose ethers like methyl cellulose (MC), ethyl cellulose, hydroxypropyl cellulose (HPC), sodium carboxymethyl cellulose (CMC), calcium carboxymethyl cellulose, methylethyl cellulose, methylhydroxyethyl cellulose, hydroxypropylmethyl cellulose (HPMC), hydroxybutylmethyl cellulose, ethylhydroxyethyl cellulose, sodium carboxymethyl-hydroxyethyl cellulose, and carboxymethylethyl cellulose, and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide (HEC-LDME), such as Quatrisoft® LM200 (Amerchol Corp.) as well as hydroxyethyl cellulose grafted with alkyl $C_{12}$–$C_{14}$ chains. The overcoat is non-porous. Optionally, particles or beads, inorganic or organic, can be present in the overcoat in an amount up to about 40 weight percent total solids. Such particles can be used for various purposes, to increase solids, to provide a matte finish, as a filler, as a viscosity reducer, and/or to increase smudge resistance. The use of aluminosilicate particles to increase smudge resistance is disclosed in U.S. Ser. No. 10/705,057 by Charles E. Romano, Jr. et al., titled "Ink Jet Recording element and Printing Element" filed Nov. 10, 2003, hereby incorporated by reference in its entirety.

The ink-receiving layer comprises from about 5 to 30 percent by weight solids of particles of a synthetic aluminosilicate material, preferably about 8 to 20, more preferably 10 to 18 wt % of the overcoat solids. The aluminosilicate is similar to natural allophane, but is a synthetically produced material not derived from a natural or purified natural aluminosilicate material and that is substantially amorphous. In one embodiment the particles are in the form of spheres or rings, preferably substantially spherical spheres 1 to 10 nm in average diameter, as observable under an electron microscope. The primary particles can be in the form of clusters of primary particles. It is a polymeric aluminosilicate material having the formula:

$$Al_xSi_yO_a(OH)_b.nH_2O$$

where the ratio of x:y is between 0.5 and 4, a and b are selected such that the rule of charge neutrality is obeyed; and n is between 0 and 10.

In a preferred embodiment, the polymeric aluminosilicate has the formula:

$$Al_xSi_yO_a(OH)_b.nH_2O$$

where the ratio of x:y is between 1 and 3.6, preferably 1 to 3, more preferably 1 to 2, and a and b are selected such that the rule of charge neutrality is obeyed; and n is between 0 and 10. More preferably, it is a substantially amorphous aluminosilicate, spherical or ring shaped, with a general molar ratio of Al to Si not more than 2:1.

The polymeric aluminosilicate can be obtained by the controlled hydrolysis by an aqueous alkali solution of a mixture of an aluminum compound such as halide, perchloric, nitrate, sulfate salts or alkoxides species $Al(OR)_3$, and a silicon compound such as alkoxides species, wherein the molar ratio Al/Si is maintained between 1 and 3.6 and the alkali/Al molar ratio is maintained between 2.3 and 3. Such materials are described in French patent application FR 02/9085, hereby incorporated by reference in its entirety.

The polymeric aluminosilicate can be obtained by the controlled hydrolysis by an aqueous alkali solution of a mixture of an aluminum compound such as halide, perchloric, nitrate, sulfate salts or alkoxides species $Al(OR)_3$ and a silicon compound made of mixture of tetraalkoxide $Si(OR)_4$ and organotrialkoxide $R'Si(OR)_3$, wherein the molar ratio is maintained between 1 and 3.6 and the alkali/Al molar ratio is maintained 2.3 and 3. Such materials are described in French patent application FR 02/9086, hereby incorporated by reference in its entirety.

Synthetic hollow aluminosilicates are disclosed in U.S. Pat. No. 6,254,845 issued Jul. 3, 2001 to Ohashi et al., titled "Synthesis Method Of Spherical Hollow Aluminosilicate Cluster," hereby incorporated by reference. As mentioned earlier, the method used therein results in a synthetic allophane in which powder X-ray diffraction reveals two broad peaks close to 27° and 40° at 2θ on the Cu—$K_\alpha$ line, which correspond to a non-crystalline (substantially amorphous) structure and which is characteristic of spherical particles referred to as allophane. In some cases, allophanes have also been characterized as giving weak XRD peaks at least at about 2.2 and 3.3. The method of synthesis may affect the XRD pattern, however, and depending on the preparation, additional peaks may be present at about 7.7 to 8.4 Å and/or about 1.40 Å.

The aluminosilicate of the present invention includes materials termed "synthetic allophane" or "allophane like." Synthetic allophane is typically in the form of substantially spherically or ring shaped aluminosilicate particles, including hollow spherical aluminosilicate particles, preferably having an average diameter of between 3.5 and 5.5 nm. In addition, synthetic allophanes, like natural allophanes, are substantially amorphous (P. Bayliss, Can. Mineral. Mag., 1987, 327), compared to, for example, imogolites which are crystalline and fibril shaped. Synthetic allophane differs from natural allophane (such as Allophosite® sold by Sigma) in that it does not contain iron. It may also be more amorphous and acidic.

In more detail, a preferred method for preparing an aluminosilicate polymer comprises the following steps:

(a) treating a mixed aluminum and silicon alkoxide only comprising hydrolyzable functions, or a mixed aluminum and silicon precursor resulting from the hydrolysis of a mixture of aluminum compounds and silicon compounds only comprising hydrolyzable functions, with an aqueous alkali, in the presence of silanol groups, the aluminum concentration being maintained at less than 1.0 mol/l, the Al/Si molar ratio being maintained between 1 and 3.6 and the alkali/Al molar ratio being maintained between 2.3 and 3;

(b) stirring the mixture resulting from step (a) at ambient temperature in the presence of silanol groups long enough to form the aluminosilicate polymer; and (c) eliminating the byproducts formed during steps (a) and (b) from the reaction medium.

The expression "hydrolyzable function" means a substituent eliminated by hydrolysis during the process and in particular at the time of treatment with the aqueous alkali. The expression "unmodified mixed aluminum and silicon alkoxide" or "unmodified mixed aluminum and silicon precursor" means respectively a mixed aluminum and silicon alkoxide only having hydrolyzable functions, or a mixed aluminum and silicon precursor resulting from the hydrolysis of a mixture of aluminum compounds and silicon compounds only having hydrolyzable functions. More generally, an "unmodified" compound is a compound that only comprises hydrolyzable substituents.

Step (c) can be carried out according to different well-known methods, such as washing or diafiltration.

The aluminosilicate polymer material obtainable by the method defined above has a substantially amorphous structure shown by electron diffraction. This material is characterized in that its Raman spectrum comprises in spectral region 200–600 $cm^{-1}$ a wide band at 250±6 $cm^{-1}$, a wide intense band at 359±6 $cm^{-1}$, a shoulder at 407±7 $cm^{-1}$, and a wide band at 501±6 $cm^{-1}$, the Raman spectrum being produced for the material resulting from step (b) and before step (c).

Alternatively, hybrid aluminosilicate polymers involving the introduction of functions, in particular organic functions into the inorganic aluminosilicate polymer enables a hybrid aluminosilicate polymer to be obtained in comparison to inorganic aluminosilicate polymers. A method for preparing a hybrid aluminosilicate polymer, comprises the following steps:

(a) treating a mixed aluminum and silicon alkoxide of which the silicon has both hydrolyzable substituents and a non-hydrolyzable substituent, or a mixed aluminum and silicon precursor resulting from the hydrolysis of a mixture of aluminum compounds and silicon compounds only having hydrolyzable substituents and silicon compounds having a non-hydrolyzable substituent, with an aqueous alkali, in the presence of silanol groups, the aluminum concentration being maintained at less than 0.3 mol/l, the Al/Si molar ratio being maintained between 1 and 3.6 and the alkali/Al molar ratio being maintained between 2.3 and 3;

(b) stirring the mixture resulting from step (a) at ambient temperature in the presence of silanol groups long enough to form the hybrid aluminosilicate polymer; and (c) eliminating the byproducts formed during steps (a) and (b) from the reaction medium.

The expression "non-hydrolyzable substituent" means a substituent that does not separate from the silicon atom during the process and in particular at the time of treatment with the aqueous alkali. Such substituents are for example hydrogen, fluoride or an organic group. On the contrary the expression "hydrolyzable substituent" means a substituent eliminated by hydrolysis in the same conditions. The expression "modified mixed aluminum and silicon alkoxide" means a mixed aluminum and silicon alkoxide in which the aluminum atom only has hydrolyzable substituents and the silicon atom has both hydrolyzable substituents and a non-hydrolyzable substituent. Similarly, the expression "modified mixed aluminum and silicon precursor" means a precursor obtained by hydrolysis of a mixture of aluminum compounds and silicon compounds only having hydrolyzable substituents and silicon compounds having a non-hydrolyzable substituent. This is the non-hydrolyzable substituent that will be found again in the hybrid aluminosilicate polymer material of the present invention. More generally, an "unmodified" compound is a compound that only consists of hydrolyzable substituents and a "modified" compound is a compound that consists of a non-hydrolyzable substituent. This material is characterized by a Raman spectrum similar to the material obtained in the previous synthesis, as well as bands corresponding to the silicon non-hydrolyzable substituent (bands linked to the non-hydrolyzable substituent can be juxtaposed with other bands), the Raman spectrum being produced for the material resulting from step (b) and before step (c).

The aluminosilicate of the present invention has several desirable properties. Most importantly, it very clearly prevents dye bleed following exposure to heat and humidity when used with a mordant in the ink receiving layer.

Referring again to the hydrophilic absorbing layers, dye mordants are added to at least the ink-receiving layer, optionally also in the optional base layer and/or the optional overcoat, in order to improve water and humidity resistance throughout the ink-recording element. Any polymeric mordant can be used in the hydrophilic absorbing layer or layers of the invention provided it does not adversely affect light fade resistance unduly. Preferably, for example, there may be used a cationic polymer, e.g., a polymeric quaternary ammonium compound, such as poly(dimethylaminoethyl)-methacrylate, polyalkylenepolyamines, and products of the condensation thereof with dicyanodiamide, amine-epichlorohydrin polycondensates, lecithin and phospholipid compounds. Examples of mordants useful in the invention include vinylbenzyl trimethyl ammonium chloride/ethylene glycol dimethacrylate, vinylbenzyl trimethyl ammonium chloride/divinyl benzene, poly(diallyl dimethyl ammonium chloride), poly(2-N,N,N-trimethylammonium)ethyl methacrylate methosulfate, poly(3-N,N,N-trimethyl-ammonium) propyl methacrylate chloride, a copolymer of vinylpyrrolidinone and vinyl(N-methylimidazolium chloride, and hydroxyethyl cellulose derivitized with (3-N,N,N-trimethylammonium)propyl chloride.

Preferably, in one embodiment, at least the ink-receiving layer and optionally both the ink-receiving layer and, if present, the base layer contains a cationic polymer comprising an effective amount of a cationic monomeric unit (mordant moiety). The cationic polymer can be water-soluble or can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyper-branched, grafted, random, blocked, or can have other polymer microstructures well known to those in the art. They also can be partially crosslinked. Examples of core/shell particles useful in the invention are disclosed in U.S. Pat. No. 6,619,797 issued Sep. 16, 2003 to Lawrence et al., titled "Inkjet Printing Method." Examples of water-dispersible particles useful in the invention are disclosed in U.S. Pat. No. 6,454,404 issued Sep. 24, 2002 to Lawrence et al., titled "Inkjet Printing Method," and U.S. Pat. No. 6,503,608 issued Jan. 7, 2003 to Lawrence et al., titled "Inkjet Printing Method."

Preferably, cationic, polymeric particles comprising at least 10 mole percent of a cationic mordant moiety (monomeric unit) are employed in the ink-receiving layer.

Such cationic, polymeric particles useful in the invention can be derived from nonionic, anionic, or cationic monomers. In a preferred embodiment, combinations of nonionic and cationic monomers are employed. The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters [usually referred to as methacrylate], vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitriles, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The water insoluble, cationic, polymeric particles employed in this invention can be prepared using conventional polymerization techniques including, but not limited to bulk, solution, emulsion, or suspension polymerization. They are also commercially available usually from a variety of sources.

The amount of water insoluble, cationic, polymeric particles used, especially in the ink-receiving layer, should be high enough so that the images printed on the recording element will have a sufficiently high density. In a preferred embodiment of the invention, the cationic, polymeric particles are used in the amount of about 5 to 30 weight percent solids, preferably 10 to 20 weight percent in the ink-receiving layer. If present, an optional base layer may contain an amount of mordant particles in the same range.

Examples of other water insoluble, cationic, polymeric particles which may be used in the invention include those described in U.S. Pat. No. 3,958,995, hereby incorporated by reference in its entirety. Specific examples of these polymers include, for example, a copolymer of (vinylbenzyl)trimethylammonium chloride and divinylbenzene (87:13 molar ratio); a terpolymer of styrene, (vinylbenzyl) dimethylbenzylamine and divinylbenzene (49.5:49.5:1.0 molar ratio); and a terpolymer of butyl acrylate, 2-aminoethylmethacrylate hydrochloride and hydroxyethylmethacrylate (50:20:30 molar ratio).

The support for the inkjet recording element used in the invention can be any of those usually used for inkjet receivers, such as resin-coated paper, paper, polyesters, or microporous materials such as polyethylene polymer-containing material sold by PPG Industries, Inc., Pittsburgh, Pa. under the trade name of Teslin®, Tyvek ® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly (butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated or poly(ethylene terephthalate) paper is employed.

The support used in the invention may have a thickness of from 50 to 500 μm, preferably from 75 to 300 μm. Antioxidants, antistatic agents, plasticizers and other known additives may be incorporated into the support, if desired.

In order to improve the adhesion of the base layer or, in the absence of a base layer, the ink-receiving layer, to the support, the surface of the support may be subjected to a corona-discharge treatment prior to applying a subsequent layer. The adhesion of the ink recording layer to the support may also be improved by coating a subbing layer on the support. Examples of materials useful in a subbing layer include halogenated phenols and partially hydrolyzed vinyl chloride-co-vinyl acetate polymer Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied.

After coating, the layers are generally dried by simple evaporation, which may be accelerated by known techniques such as convection heating.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

Matte particles may be added to any or all of the layers described in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

In another embodiment of the invention, a filled layer containing light scattering particles such as titania may be situated between a clear support material and the ink receptive multilayer described herein. Such a combination may be effectively used as a backlit material for signage applications. Yet another embodiment which yields an ink receiver with appropriate properties for backlit display applications results from selection of a partially voided or filled poly (ethylene terephthalate) film as a support material, in which the voids or fillers in the support material supply sufficient light scattering to diffuse light sources situated behind the image.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro-crystalline cellulose, zinc oxide, talc, and the like. The filler loaded in the backing layer is generally less than 5 percent by weight of the binder component and the average particle size of the filler material is in the range of 5 to 30 μm. Typical binders used in the backing layer are polymers such as polyacrylates, gelatin, polymethacrylates, polystyrenes, polyacrylamides, vinyl chloride-vinyl acetate copolymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octylsulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

While not necessary, the hydrophilic material layers described above may also include a cross-linker. Such an additive can improve the adhesion of the ink receptive layer to the substrate as well as contribute to the cohesive strength and water resistance of the layer. Cross-linkers such as carbodiimides, polyfunctional aziridines, melamine formaldehydes, isocyanates, epoxides, and the like may be used. If a cross-linker is added, care must be taken that excessive amounts are not used as this will decrease the swellability of the layer, reducing the drying rate of the printed areas.

The coating composition can be coated either from water or organic solvents, however water is preferred. The total solids content should be selected to yield a useful coating thickness in the most economical way, and for particulate coating formulations, solids contents from 10–40% are typical.

Inkjet inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758.

The following example is provided to illustrate the invention.

PREPARATION 1

This example illustrates the preparation of an aluminosilicate that can be employed in the present invention. Osmosed water in the amount of 100 l was poured into a plastic (polypropylene) reactor. Then, 4.53 moles $AlCl_3$, $6H_2O$, and then 2.52 moles tetraethyl orthosilicate were added. This mixture was stirred and circulated simultaneously through a bed formed of 1 kg of glass beads, 2-mm diameter, using a pump with 8-1/min output. The operation to prepare the unmodified mixed aluminum and silicon precursor took 90 minutes. Then, 10.5 moles NaOH 3M were added to the contents of the reactor in two hours. Aluminum concentration was $4.4\times10^{-2}$ mol/l, Al/Si molar ratio 1.8 and alkali/Al ratio 2.31. The reaction medium clouded. The mixture was stirred for 48 hours. The medium became clear. The circulation was stopped in the glass bead bed. The aluminosilicate polymer material according to the present invention was thus obtained in dispersion form. Finally, nanofiltration was performed to pre-concentration by a factor of 3, followed by diafiltration using a Filmtec® NF 2540 nanofiltration membrane (surface area 6 $m^2$) to eliminate the sodium salts to obtain an Al/Na ratio greater than 100. The retentate resulting from the diafiltration by nanofiltration was concentrated to obtain a gel with about 20% by weight of aluminosilicate polymer.

PREPARATION 2

Another example of the preparation of aluminosilicate particles was as follows. Demineralized water in the amount of 56 kg was poured into a glass reactor. Then, 29 moles $AlCl_3.6H_2O$, were dissolved in the water and the reactor was heated to 40° C. Then, 19.3 moles tetraethyl orthosilicate were added. This mixture was stirred for 15 minutes. Next, 74.1 moles of triethylamine were metered into the mixture in 75 minutes. The mixture was allowed to stir overnight. The mixture was diafiltered with a 20K MWCO spiral wound polysulfone membrane (Osmonics® model S8J) until the conductivity of the permeate was less than 1000 μS/cm. The reaction mixture was then concentrated by ultrafiltration. The yield was 41.3 kg at 6.14% solids (95%).

EXAMPLE 1

Solution for Control Ink-Receiving Layer 1 (Control Solution 1)—A liquid solution was made by dissolving a partially hydrolyzed polyvinyl alcohol (GH-17® from Nippon Gohsei) in water.

Solution for Control Ink-Receiving Layer 2 (Control Solution 2)—Prepared in the same way as the Control Solution 1 except that 20 parts of the GH-17 is replaced with a cationic mordant: latex copolymer of vinylbenzyl trimethylammonium chloride: divinyl benzene (87:13 molar ratio) prepared as in U.S. Pat. No. 3,958,995 that has been diafiltered as in U.S. Pat. No.6,303,212).

Solution for Control Ink-Receiving Layer 3 (Control Solution 3)—Prepared in the same way as the Control Solution 1 except that 20 parts of the GH-17 is replaced with the above-prepared aluminosilicate particles.

Solution for Invention Ink-Receiving layer 1 (Invention Solution 1)—Prepared in the same way as the Solution 1 except that 20 parts of the GH-17 is replaced with the 10 parts of the cationic mordant used in Solution 2 and 10 parts of the above-prepared aluminosilicate.

Control Recording Elements—Control Recording Element 1 was made by coating Control Solution 1 over corona discharge treated polyethylene resin coated paper using a multiple slot hopper. A portion of the coating solution was diluted with water to 3% solids and coated out of the bottom slot of the hopper. Another portion of the solution was coated directly on top using the top slot of the hopper after adding 1 part Olin 10G® (Olin Corp) surfactant to 1700 parts coating solution. The coating Was dried thoroughly by forced air heat after application of the coating solutions. The total dry coating thickness was 9 microns. The Control Recording Elements 2 and 3 were made the same way except using Control Solutions 2 and 3.

Inventive Recording Element 1—The Inventive Recording Element 1 was made the same way as the Control Recording Element 1 except that Invention Solution 1 was used instead of Control Solution 1.

Testing

A test pattern was created consisting of twenty 0.5 inch squares of micro-lines printed at various frequency and density. The target uses yellow, magenta and cyan inks to create the gray micro-line squares.

The coating variations were printed on a Kodak PPM 200 inkjet printer. The gray patches were measured for colorimetry (L* a* b* on a reflection colorimeter) before and after incubation to look for a change in color after incubation. Delta E is change in colorimetry expressed by the following equation:

$$\text{Delta } E = sqrt\ ((L^*_i - L^*_o)^2 + (a^*_i - a^*_o)^2 + (b^*_i - b^*_o)^2)$$

wherein sqrt is the square root, $L^*_i$ is the L* before incubation and $L^*_o$ is the L* after incubation for 5 hours at 29.5° C. and 95% RH (relative humidity) of the gray square;

wherein $a^*_i$ is the a* before incubation and $a^*_o$ is the a* after incubation for 5 hours at 29.5° C. and 95% RH of the gray square; and wherein $b^*_i$ is the b* before incubation and $b^*_o$ is the b* after incubation for 5 hours at 29.5° C. and 95% RH of the gray square.

Total Delta E is the sum of the Delta E for all 20 squares. Delta E Max is the maximum shift of any one square. A total Delta E above 80 is considered unacceptable for color shift. A Delta E max above 15 is considered unacceptable for color shift. The results of the testing are shown in Table 1 below.

TABLE 1

| Element | Variation Description | Total Delta E | Delta E Max |
|---|---|---|---|
| Control 1 | PVA | 273.8 | 37.1 |
| Control 2 | PVA + Cationic Mordant | 271.3 | 45.1 |
| Control 3 | PVA + Aluminosilicate Particles | 207.9 | 24.9 |
| Invention 1 | PVA + Mordant + Aluminosilicate Particles | 75.8 | 14.7 |

The above Table 1 shows that the invention variation (containing 10 wt % aluminosilicate particles and 10% cationic mordant) is the only combination that is acceptable for total Delta E color shift and Delta E max color shift after the prints are exposed to heat and humidity.

The invention claimed is:

1. An inkjet recording element comprising a support having thereon a non-porous ink-receiving layer comprising a hydrophilic binder, a cationic or anionic polymeric mordant, and particles of a synthetic, substantially amorphous aluminosilicate material, the primary particles thereof having an average diameter of 1 to 10 nm, wherein the synthetic, substantially amorphous aluminosilicate material exhibits an X-ray diffraction pattern that comprises weak peaks at about 2.2 and 3.3 Å, wherein the ratio of hydrophilic binder to the synthetic, substantially amorphous aluminosilicate particles is about from about 95:5 to about 75:25.

2. The inkjet recording element of claim 1 wherein the hydrophilic binder comprises poly(vinyl alcohol).

3. The inkjet recording element of claim 1 wherein the polymeric mordant is a cationic polymer.

4. The inkjet recording element of claim 3 wherein the cationic polymer in the ink-receiving layer is a polymeric quaternary ammonium.

5. The inkjet recording element of claim 4 wherein the polymeric quaternary ammonium comprises monomeric units derived from vinylbenzene trimethyl ammonium chloride.

6. The inkjet recording element of claim 1 wherein the inkjet recording element further comprises a base layer located between the ink-receiving layer and the support.

7. The inkjet recording element of claim 1 wherein the inkjet recording element further comprises an overcoat.

8. The inkjet recording element of claim 1 wherein the synthetic, substantially amorphous aluminosilicate particles are substantially in the form of hollow spheres.

9. The inkjet recording element of claim 1 wherein the synthetic, substantially amorphous aluminosilicate material is a synthetic allophane with essentially no iron atoms.

10. The inkjet recording element of claim 1 wherein the synthetic, substantially amorphous aluminosilicate material is a synthetic allophane having a positive charge.

11. The inkjet et recording element of claim 1 wherein the synthetic, substantially amorphous particles comprise a polymeric aluminosilicate having the formula:

$$Al_xSi_yO_a(OH)_b.nH_2O$$

where the ratio of x:y is between 0.5 and 4, a and b are selected such that the rule of charge neutrality is obeyed; and n is between 0 and 10.

12. The inkjet recording element of claim 11 wherein the polymeric aluminosilicate has the formula:

$$Al_xSi_yO_a(OH)_b.nH_2O$$

where the ratio of x:y is between 1 and 3.6, and a and b are selected such that the rule of charge neutrality is obeyed; and n is between 0 and 10.

13. The inkjet recording element of claim 11 wherein the synthetic, substantially amorphous aluminosilicate material is present in the ink-receiving layer in an amount of 5 to 30 weight percent solids and comprise substantially spherical hollow spheres, wherein the material is represented by the formula:

$$Al_xSi_yO_a(OH)_b.nH_2O$$

where the ratio of x:y is between 1 and 3.6, and a and b are selected such that the rule of charge neutrality is obeyed; and n is between 0 and 10.

14. The inkjet recording element of claim 13 wherein the ink-receiving layer comprises a binder in the amount of at least 65 weight percent based on total solids.

15. The inkjet recording element of claim 1 wherein the synthetic, substantially amorphous aluminosilicate material is a polymeric aluminosilicate comprising organic groups.

16. The inkjet recording element of claim 1 wherein the average particle size of the synthetic, substantially amorphous particles is in the range from about 3 nm to about 6 nm.

17. The inkjet recording element of claim 1 wherein the synthetic, substantially amorphous particles are present in an amount of 5 to 30 weight percent solids.

18. The inkjet recording element of claim 1 wherein the particles are present in the ink-receiving layer in an amount of 5 to 18 weight percent solids.

19. An inkjet printing method, comprising the steps of:

A) providing an inkjet printer that is responsive to digital data signals;

B) loading the inkjet printer with the inkjet recording element of claim 1;

C) loading the inkjet printer with an inkjet ink; and

D) printing on the inkjet recording element using the inkjet ink in response to the digital data signals.

* * * * *